United States Patent [19]

Glenn

[11] 4,053,347

[45] Oct. 11, 1977

[54] METHOD FOR FORMING AN INTERNAL TAPER IN THE WALLS OF A SLEEVE-LIKE BODY

[75] Inventor: Richard C. Glenn, Hempfield Township, Westmoreland County, Pa.

[73] Assignee: United States Steel Corporation, Pittsburgh, Pa.

[21] Appl. No.: 339,484

[22] Filed: Mar. 8, 1973

[51] Int. Cl.[2] ..... C23F 1/02

[52] U.S. Cl. ..... 156/637; 156/642; 156/644; 156/666

[58] Field of Search ..... 156/2, 7, 18, 19, 25, 156/345, 637, 642, 644, 666; 134/22, 23, 24, 144; 118/214; 259/147, 151, DIG. 17, 4; 261/119 A; 137/577; 204/129.1, 129.2

[56] References Cited

U.S. PATENT DOCUMENTS

| | | | |
|---|---|---|---|
| 2,762,150 | 9/1956 | Edds | 134/144 |
| 2,881,059 | 4/1959 | Spencer | 156/7 |
| 2,883,275 | 4/1959 | Hirdler, Jr. | 156/345 |
| 2,963,415 | 12/1960 | MacDonald | 259/147 |
| 3,023,139 | 2/1962 | Van Tetterode | 156/24 |
| 3,274,985 | 9/1966 | Traver et al. | 137/577 |
| 3,650,959 | 3/1972 | Shipley et al. | 156/18 |
| 3,723,268 | 3/1973 | Johns et al. | 204/129.1 |
| 3,773,577 | 11/1973 | Shibasaki et al. | 156/18 |

*Primary Examiner*—Charles E. Van Horn
*Assistant Examiner*—Jeremie Massie
*Attorney, Agent, or Firm*—Walter P. Wood

[57] ABSTRACT

A chemical machining method and apparatus for forming an internal tpaer in the walls of a sleeve-like body, such as a copper liner of a continuous-casting mold. The body is partially filled with an etching solution, whereby the inside faces of the body are exposed to a pool of the solution. The pool is agitated by blowing air therethrough. By proper control of the rate at which the level of the pool rises or falls within the body, any form of linear or curvilinear taper can be obtained.

8 Claims, 3 Drawing Figures

METHOD FOR FORMING AN INTERNAL TAPER IN THE WALLS OF A SLEEVE-LIKE BODY

This invention relates to an improved method and apparatus for forming an internal taper in the walls of a sleeve-like body.

Although my invention is not thus limited, my method and apparatus are particularly useful for forming a taper in the walls of a mold liner used in continuously casting metals. A conventional continuous-casting mold includes a sleeve-like liner, usually copper, and backing members, usually steel, fixed to the outside of the liner. Liquid metal is teemed continuously through the liner, while water circulates through channels formed between the liner and backing members to cool the liner and solidify a skin on the outside of the casting before it leaves the mold. A casting, which at this stage has only a thin outside skin and a liquid core, emerges continuously from the bottom of the mold. Reference can be made to Gallucci U.S. Pat. No. 3,618,658 or Bower U.S. Pat. No. 3,709,286, both of common ownership, for exemplary showings of continuous-casting molds.

It is known that advantages can be obtained by tapering the internal faces of the liner walls. A casting contracts as its skin solidifies, whereby the skin tends to pull away from untapered liner walls. If the skin loses contact with the liner too soon, areas of the casting where contact is lost cool less efficiently. Surface defects, such as corner cracks, may appear in the casting as a result. The presently preferred configuration of taper corresponds with the contraction of the casting. This is a curvilinear taper in which the angle is at a maximum at the top of the liner, gradually diminishes downwardly, and ceases altogether somewhat above the bottom of the liner. Typically the taper may be on the order of 0.001 to 0.003 inch per inch of liner height at the top of the liner and gradually fade out to no taper at about 25 to 35 inches below the top. A taper of such small magnitude is scarcely visible to the unaided eye. Reference can be made to Baier U.S. Pat. No. 3,124,855 or Stauffer et al U.S. Pat. No. 3,563,298 for exemplary showings of liners which have tapered walls.

Heretofore the only known ways of forming a taper in a liner wall have been by mechanically machining the interior surfaces, or by costly back-extrusion or die forming. It is a difficult operation for even a skilled machinist to machine the walls accurately to a taper of the small magnitude required. Also, with such methods, it has been possible only to approximate the curvilinear taper desired with a series of linearly tapered sections, each at a smaller angle to the vertical than the section above.

My invention involves forming a taper in the walls of a sleeve-like body by a "chemical machining" process; that is, I expose the inside surfaces of the body to a pool of etching solution under precisely controlled conditions which produce a taper formed accurately to any desired configuration. I am aware that it is known to employ an etching solution to form an internal taper in the walls of a tube, for example as shown in Edds U.S. Pat. No. 2,762,150, but methods known previously are not suitable for my purposes. The method shown in the Edds patent involves the use of a rotating nozzle wheel through which the etching solution is impinged on the inside surface of the tube. For internal etching, this method is useful only for tubes of circular cross section, while the articles in which I am mainly interested, mold liners, usually are of rectangular or square cross section. Furthermore the known method necessitates moving a heavy workpiece as the solution impinges on its surface, and creates a significant quantity of noxious vapors as the solution discharges from the nozzle.

An object of my invention is to provide an improved method and apparatus for forming an internal taper in the walls of a sleeve-like body of any cross section, such as a rectangular or square mold liner, in which the tapering operation is performed rapidly and accurately and the tapered surface may have any desired linear or non-linear configuration.

A further object is to provide an improved tapering method and apparatus which can be performed and operated by relatively unskilled personnel.

A further object is to provide an improved chemical machining method and apparatus in which I expose the inside faces of a sleeve-like body to a pool of etching solution and control the configuration of the taper by controlling the rate of rise or fall of the level of the pool surface.

A further object is to provide an improved tapering method and apparatus in which the taper in the inside walls of a sleeve like body is formed by chemical machining, but in which I overcome the difficulties encountered in previous chemical machining processes; that is, in which I partially fill the body with etching solution and control the duration of exposure of the body to the solution at each level to produce an accurately contoured taper.

PREFERRED APPARATUS

Figure 1:
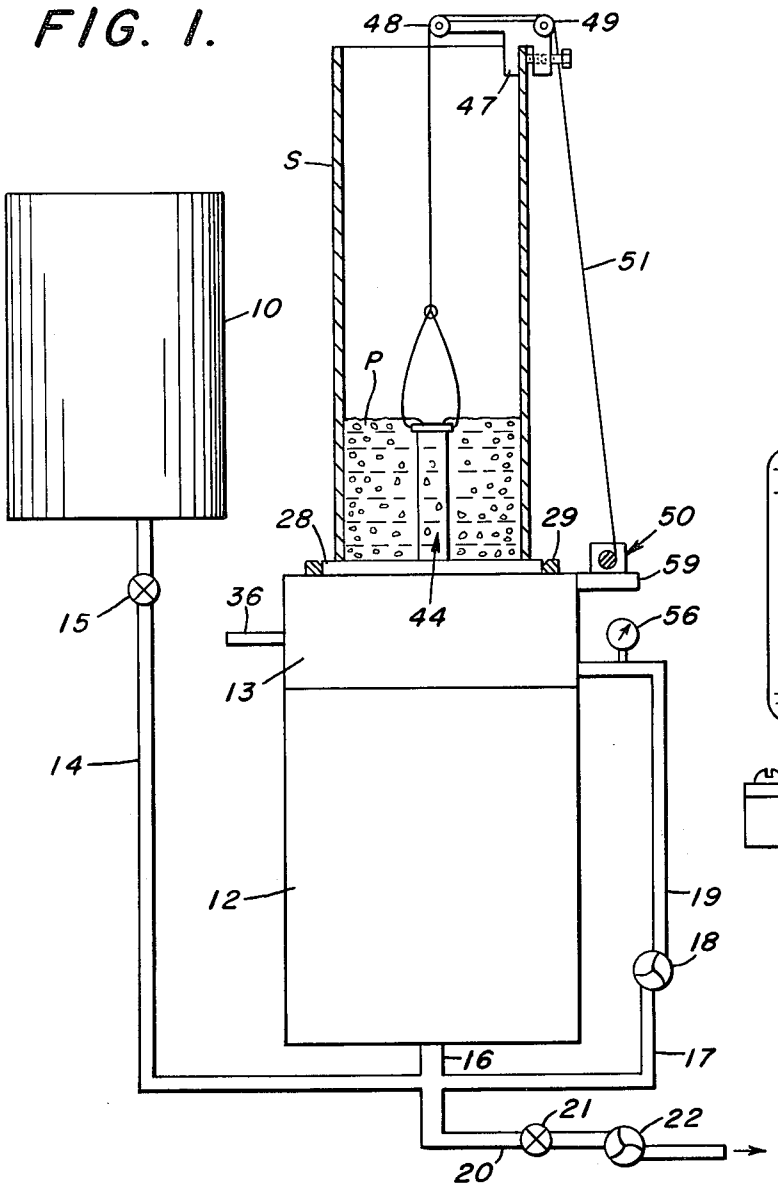
FIG. 1 is a side elevational view, partly diagrammatic and partly in section, of a tapering apparatus of my preferred construction set up for operation.

As shown in FIG. 1, the apparatus comprises a mixing tank 10, a reserve tank 12, and a base member 13 supported on the latter tank. On the base member 13, I position a sleeve-like body S, the walls of which are to be internally tapered. In the example of a mold liner, I invert the body from its position for casting. A pipe 14, which contains a valve 15, extends from the mixing tank to a pipe 16 communicating with the bottom of the reserve tank. A pipe 17 extends from the pipe 16 to the intake side of a pump 18. A pipe 19 extends from the discharge side of the pump to an inlet port in the base member 13. I mix a measured quantity of an etching solution, hereinafter described, in tank 10 and transfer this solution to tank 12 via pipes 14 and 16. Pipe 16 can function also as an outlet from tank 12, whereby pump 18 can circulate solution from said outlet through pipes 17 and 19, the base member 13, the body S, and back into the tank, as also hereinafter explained. Pipe 16 also connects with a drain pipe 20 which contains a valve 21 and leads to the intake side of a drain pump 22.

Figure 2:
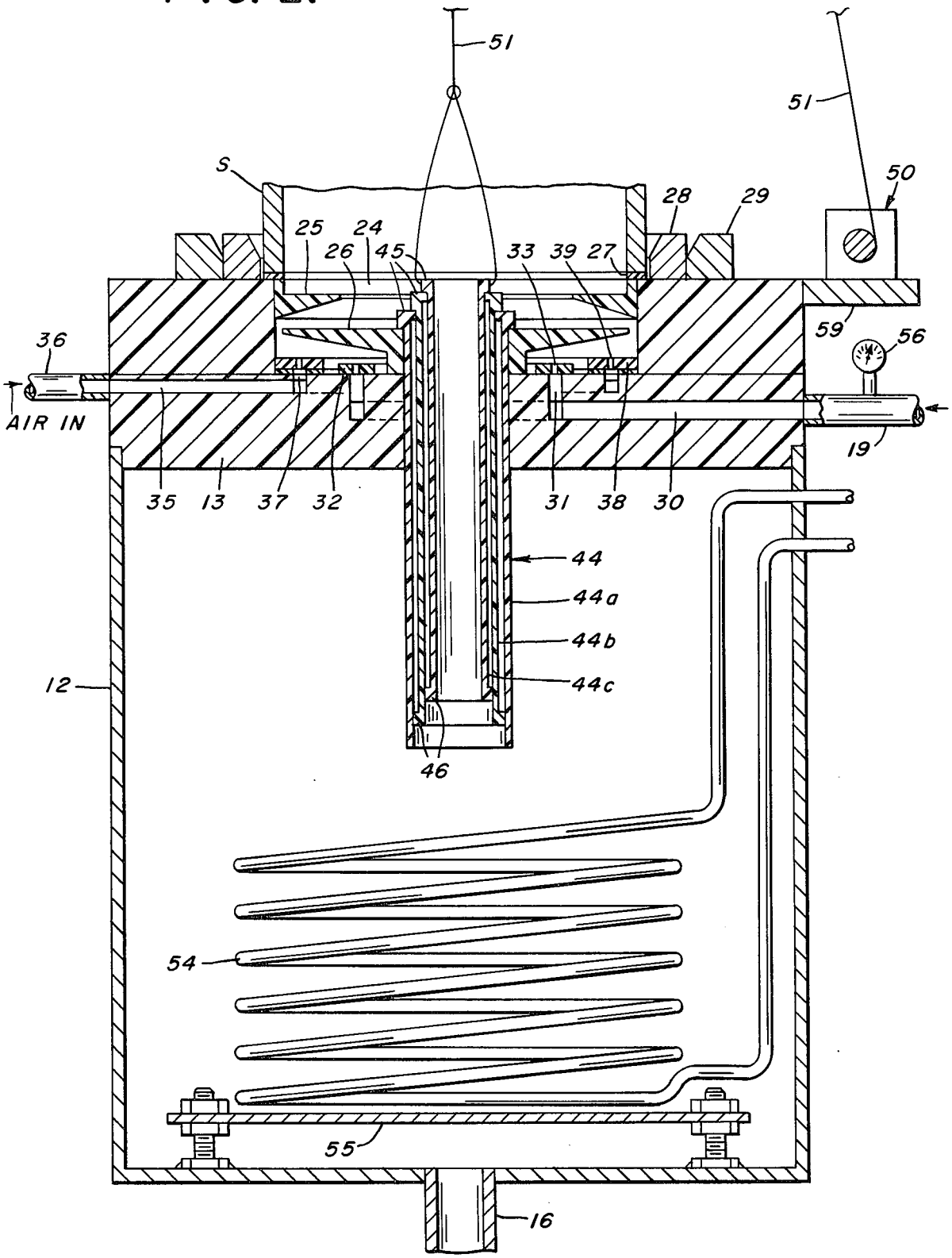
FIG. 2 is a vertical sectional view on a larger scale of a portion of the apparatus.

As shown in FIG. 2, the base member 13 has a shallow upwardly facing chamber 24 within which I mount an inwardly projecting upper baffle 25 and an outwardly projecting lower baffle 26. The body S rests on a gasket 27 which overlies the upper face of the base member and the edge of the upper baffle 25. The gasket normally prevents etching solution from leaking under the lower edge of the body. The body is held in place by a surrounding closely fitting frame 28 and cleats 29 outside the frame. The base member has a first set of interconnected horizontal passages 30 with which pipe 19 is connected. These passages lead to a series of upwardly extending passages 31 arranged in a pattern which extends all the way around the floor of chamber 24. The chamber floor carries a ring 32 which has upwardly facing ports 33 communicating with the respective passages 31 under the lower baffle 26. The base member has a second set of interconnected horizontal passages 35 with which I connect a compressed air line 36. Passages 35 lead to a series of upwardly extending passages 37 likewise arranged in a pattern all the way around the floor of chamber 24. The chamber floor carries a second ring 38 which surrounds the first ring and has upwardly facing ports 39 communicating with the respective passages 37. Ports 39 are closer to the outside edge of the floor than the ports 33, but also under the lower baffle 26. The rings 32 and 38 are of the same shape in outline as the body S, that is, rectangular or square in the example of a rectangular or square mold liner, but of course smaller.

The central portions of the floor of chamber 24 and of the lower baffle 26 are open and receive an overflow tube 44 formed of telescoping outside, middle and inside sections **44*a*, 44*b* and 44*c*. The upper and lower ends of the tube sections are flanged, as indicated at 45 and 46, for supporting the sections on the lower baffle 26 and on one another, and for lifting the middle and outside sections when the inside section is lifted. I mount a fixture 47 on the upper end of the body S (FIG. 1). The fixture carries inner and outer pulleys 48 and 49. The base member 13 carries a winch mechanism 50 hereinafter described in detail. I attach a wire line 51 to the upper end of the inside tube section 44*c*. The wire line extends over pulleys 48 and 49 and downwardly from the latter to the winch mechanism 50. Thus operation of the winch mechanism raises first the inside tube section 44*c*, followed by the middle and outside sections 44*b* and 44*a***, or lowers these sections.

OPERATION

I transfer the etching solution to tank 12, mount the body S on the base member 13, and attach the ends of a new wire line 51 to the inside tube section **44*c* and to the winch mechanism 50 respectively. Next I turn on the air to line 36 and operate pump 18 to circulate the etching solution. Valves 15 and 21 of course are closed. In the preferred mode of operation, I operate the winch mechanism to move the overflow tube 44 continuously upwardly at a controlled slow rate. The solution discharges from the passages 30 and 31 in the base member 13 through the ports 33 and passes around baffles 26 and 25 and partially fills the body S where it forms a pool P. Air flows through the passages 35 and 37 through the ports 39 and thus continuously agitates the pool. The solution continuously overflows from the pool through the overflow tube 44 back into tank 12**, whereby the portions of the inside faces of body S below the level of the overflow tube are exposed to agitated and continuously recirculated solution. Control of the position of the overflow tube controls the level of the pool surface, which in turn controls the exposure time and the depth of etching at each level.

At the conclusion of the operation the lower end of the overflow tube clears the lower baffle 26, whereupon the solution drains from the pool back into tank 12. Next I may open valve 21 and operate pump 22 to remove the spent solution for disposal. In the event that solution commences to leak at the bottom of the body S for any reason, such as failure of gasket 27, I can stop the winch mechanism 50, and manually pull the wire line 51 to lift the overflow tube to a position in which its lower end similarly clears the lower baffle. The solution drains back into the tank, whereupon I can make the necessary repairs. Thereafter I can resume operation with the overflow tube in the same position it occupied at the time I interrupted the operation.

The etching solution in the pool P acts on the body S to etch away the material. The reaction between the solution and the material is exothermic, whereby the temperature of the solution tends to rise continuously. The solution temperature is one of several variables which affect the etching rate. Preferably I control this variable to some extent by not letting the temperature rise above a predetermined limit. The tank 12 contains a cooling coil 54 connected to a water source, and a baffle 55 fixed between the cooling coil and the outlet. Pipe 19 contains a temperature indicator 56 which continuously shows the temperature of the solution going into the horizontal passage 30 in the base member 13. When this temperature rises to a predetermined degree, for example 100°–110° F, I turn on the water to the cooling coil to prevent further significant rise. Baffle 55 assures that the solution does not bypass the coil on its way to the outlet 16.

The depth to which the inside faces of the body S are etched varies with the time during which the faces are exposed to the solution at each level. The solution first contacts the inside faces of the body at the bottom and remains in contact therewith throughout the tapering operation. The level of the pool P gradually rises as the overflow tube 44 is lifted, but at each successive level the exposure time is shorter and the depth of etching diminishes. Another variable affecting the etching rate is the strength of the etching solution. At the beginning of the operation, the solution is fresh and at its maximum strength, whereby the etching rate is relatively rapid. At the conclusion the solution may have only about 40% of its original strength, and the action is much slower. Still another variable is the head of the solution in the pool P. Preferably the pump 18 is a centrifugal pump, rather than a positive displacement pump, and its output diminshes as the head increases. I compensate for all these variables by controlling the rate at which the winch mechanism 50 lifts the overflow tube 44.

WINCH MECHANISM

Figure 3:
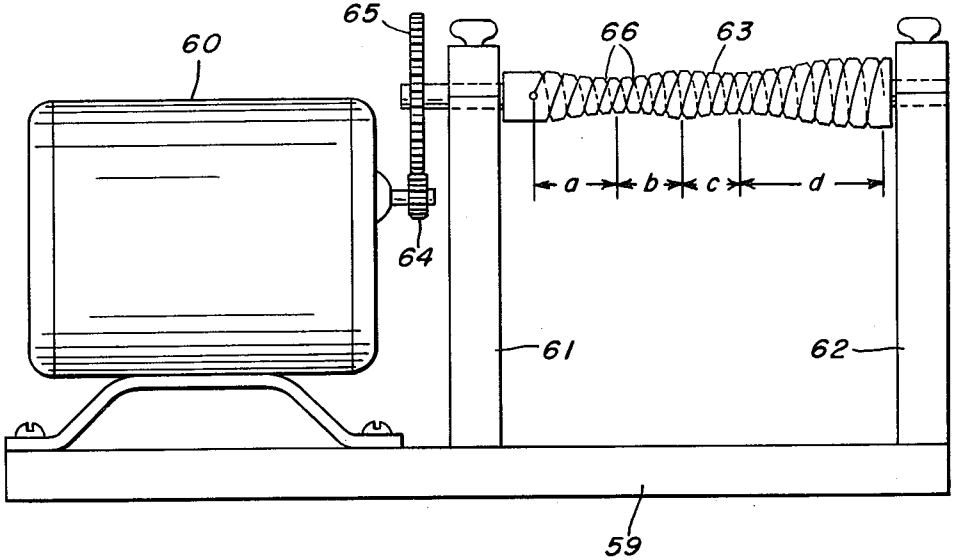
FIG. 3 is an elevational view on a still larger scale from the right of FIG. 1 showing the winch mechanism embodied in the apparatus.

FIG. 3 shows the winch mechanism 50 in detail. The mechanism includes a shelf 59 which I attach to the base member 13 and on which I mount a drive motor 60 and a pair of bearing plates 61 and 62. I journal a spindle 63 in the two bearing plates. Motor 60 is connected to the spindle through a pinion 64 and gear 65 to drive the spindle at a relatively slow rate, for example 1/5 rpm. I attach the wire line 51 to one end of the spindle, the left as shown in FIG. 3. The spindle has a helical groove 66 in which the wire line winds as the spindle rotates.

As FIG. 3 shows, the diameter of the spindle 63 varies along the length of the spindle. This variation controls the rate at which the overflow tube moves upwardly and hence controls the rate at which the level of pool P changes. This affords a means of controlling the etching rate at each level of the body S. As long as the spindle rotates at a constant angular velocity, the overflow tube of course moves faster when the wire line is winding on a portion of the spindle of larger diameter than on a portion of smaller diameter. For a hypothetical solution which maintains a constant etching rate throughout the operation, the spindle diameter would be directly proportional to the taper, but the other variables hereinbefore discussed must be taken into consideration.

I have illustrated a spindle 63 which I have found suitable for tapering the walls of a copper liner of a continuous-casting mold with my preferred etching solution hereinafter described. The mold is square in cross section with inside dimensions of 7½ x 7½ inches. The first zone *a* of the spindle at the left end has a relatively small and moderately decreasing diameter. The next zone *b* has a rapidly increasing diameter. The third zone *c* has an almost constant but slightly decreasing diameter. The last zone *d*, which occupies about 40% of the spindle length has a moderately increasing diameter. The spindle reaches its maximum diameter at the right end. The exact spindle contour of course varies for different bodies and different etching solutions.

When the wire line 51 commences to wind on the zone *a* of the spindle 63, the solution is fresh and at its maximum strength, but since the solution is contacting only the portion of the body S which is to have the maximum angle of taper (about 0.001 to 0.003 inch per inch of liner height), I want upward movement of the overflow tube 44 to be slow. When the wire line reaches the zone *b*, the solution temperature is commencing to rise and the angle of taper is diminishing, but the solution strength is not yet much weakened. Hence I accelerate the rate at which the overflow tube moves upwardly. When the wire line reaches the zone *c*, the cooling coil 54 is operating to prevent the solution temperature from rising further, the angle of taper is diminishing, and the solution is becoming weaker. These conditions call for the overflow tube to move upwardly at a nearly constant rate equal to the rate at which it was moving at the end of the zone *b*. Finally, when the wire line reaches the zone *d*, the angle of taper is diminishing rapidly, the head of solution in the body S is increasing, and the solution is becoming quite weak. Nevertheless, to produce the much diminished angle of taper, I accelerate the rate at which the overflow tube moves upwardly throughout this zone.

ETCHING SOLUTION

The etching solution may be any liquid which attacks the material of the body S without attacking the materials of the apparatus. I prepare my preferred solution for etching a copper liner by dissolving 42 pounds of $CrO_3$ in 8 gallons of water, and just before using it, I add 0.33 gallons of $H_2SO_4$ and 0.033 gallons HCl. Deviations of more than about 5% of these amounts may necessitate changes in the spindle dimensions. However, for a chromic oxide-sulfuric acid-hydrochloric acid solution, the ranges of the foregoing ingredients per liter of starting solution are about as follows:

300 to 800 grams $CrO_3$
15 to 60 ml $H_2SO_4$
1 to 30 ml HCl

Alternative solutions for etching copper are:

30 to 50% $HNO_3$ in water, or
20 to 50% $H_2O_2$ (50%) in $H_3PO_4$ (85%). Most standard copper etching solutions, such as those utilizing HCl or $NH_4OH$ as the etchant react too slowly to be useful.

From the foregoing description it is seen that my invention affords a simple, easily operated method and apparatus for accurately tapering the inside faces of a sleeve-like body. It is of course necessary to construct the apparatus of materials not subject to serious attack by the etching solution. As a practical matter I construct the tanks, pipes, and cooling coil of stainless steel, the overflow tube of "Teflon" and the base member and baffles of a plastic such as polypropylene, but many equivalents could be substituted. The pumps are constructed of stainless steel or plastic. It is also possible to practice my method in reverse, that is, to fill the body S with solution to the height at which it is to be tapered and lower the overflow tube at a controlled rate. Of course the spindle contours would be different, since solution of maximum strength would be in contact initially with the entire length to be tapered. My method and apparatus can be adapted for chemically maintaining an internal taper in bodies of any cross section, as long as the base is designed to receive the body.

I claim:

1. A method of forming an internal taper in the walls of a sleeve-like body beginning at one end of said body, said method comprising:

mounting said body in an upright stationary position with the end at which the taper is to begin at the bottom;

introducing an etching solution continuously to the interior of said body from the bottom to form a pool within the body to which pool the inside faces of the body are exposed;

agitating said pool;

continuously discharging said solution from said pool through an overflow positioned within said body;

moving said overflow vertically during the tapering operation and thus changing the level of the pool surface; and controlling the depth to which the walls are etched by control of the rate of movement of said overflow to provide maximum time of exposure to said solution at the lower end of said body and a diminishing time of exposure at each successive level thereabove.

2. A method as defined in claim 1 in which said overflow is positioned at the bottom of said body at the beginning of the tapering operation and is continuously moved upwardly as the operation progresses.

3. A method as defined in claim 1 in which said solution is continuously recirculated and is agitated by introducing compressed air thereto.

4. A method as defined in claim 1 in which said body is a copper liner of a continuous-casting mold inverted from its position for casting, said liner being of rectangular or square cross section.

5. A method as defined in claim 4 in which said solution is a chromic oxide-sulfuric acid-hydrochloric acid solution in water and initially consists per liter of solution of:

| | |
|---|---|
| $CrO_3$ | 300 to 800 grams |
| $H_2SO_4$ | 15 to 60 ml |
| HCl | 1 to 30 ml |
| balance | water |

6. A method of forming an internal taper in the walls of a sleeve-like body, said method comprising mounting said body in an upright stationary position, introducing an etching solution at a plurality of points to the lower end of said body and forming a pool within the body to which the inside faces of the body are exposed, overflowing the solution from the pool at progressively higher levels as the tapering operation progresses, whereby each successive level of the walls is exposed to solution for a shorter time, continuously recirculating solution from its points of introduction through the overflow, and introducing air to the pool to agitate the solution therein.

7. A method as defined in claim 6 in which the rate of overflow is adjusted to compensate for increases in solution temperature and head and for loss of solution strength as the tapering operation progresses.

8. A method as defined in claim 6 in which the overflow mechanism is moved clear of the lower end of the body at the conclusion of the tapering operation to permit the solution from said pool to drain from the body.

* * * * *

UNITED STATES PATENT OFFICE

CERTIFICATE OF CORRECTION

Patent No. 4,053,347 Dated October 11, 1977

Inventor(s) Richard C. Glenn

It is certified that error appears in the above-identified patent and that said Letters Patent are hereby corrected as shown below:

In the abstract, line 2, "tpaer" should read -- taper --.

Column 6, line 20, "maintaining" should read --machining--;

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*